US005984798A

United States Patent [19]

Gilmour

[11] Patent Number: 5,984,798

[45] Date of Patent: Nov. 16, 1999

[54] METHOD AND APPARATUS FOR ACHIEVING AN IMPROVED GOLF SWING

[76] Inventor: Alf J. Gilmour, 44 Durward Place, Waterloo, Ontario, Canada, N2L 4F4

[21] Appl. No.: 09/231,094

[22] Filed: Jan. 14, 1999

[30] Foreign Application Priority Data

Aug. 27, 1998 [CA] Canada ..... 2246694

[51] Int. Cl.[6] ..... A63B 69/36

[52] U.S. Cl. ..... 473/221; 473/259; 473/409

[58] Field of Search ..... 473/221, 222, 473/225, 258, 259, 409

[56] References Cited

U.S. PATENT DOCUMENTS

| | | | |
|---|---|---|---|
| 1,960,787 | 5/1934 | MacStocker . | |
| 2,520,287 | 8/1950 | Plunkett et al. | 473/259 |
| 2,653,025 | 9/1953 | Zega . | |
| 2,713,491 | 7/1955 | Plunkett . | |
| 3,744,799 | 7/1973 | Hightower . | |
| 3,776,555 | 12/1973 | Hagaman | 473/221 |
| 3,794,329 | 2/1974 | Wilson . | |
| 4,040,633 | 8/1977 | Sciarrillo . | |
| 4,852,881 | 8/1989 | Bellagamba . | |

FOREIGN PATENT DOCUMENTS 2031458 12/1990 Canada .

*Primary Examiner*—George J. Marlo
*Attorney, Agent, or Firm*—Riches, McKenzie & Herbert

[57] ABSTRACT

A golf swing training apparatus is used to produce a data signal representative of the golfer's swing tempo. The apparatus includes a golf swing guide having a number of individual induction type sensors located at spaced locations therein. Each sensor sequentially provides a computer microprocessor with sensor readings as the golf club or club shaft passes thereby. The processor thereafter converts the sensor readings into an output representative of the golf swing tempo. To analyze a particular golfer's swing, the golfer stands in the training apparatus and swings his golf club. On each of the swing backstroke, downstroke and follow-through the club slides along the swing guide sequentially activating each of the sensors. The microprocessor instantaneously converts the timing between sequential sensor readings received into a graphically displayed output providing the golfer with substantially immediate feedback of the tempo of his golf swing.

20 Claims, 5 Drawing Sheets

METHOD AND APPARATUS FOR ACHIEVING AN IMPROVED GOLF SWING

SCOPE OF THE INVENTION

The present invention relates generally to a golf swing training device and more particularly to a golf swing training device, which may be used to improve the characteristics of a person's golf club swing.

BACKGROUND OF THE INVENTION

There are a number of factors which come into play in achieving a proper golf club swing, any one of which if improperly executed may result in a poor swing. These factors include such elements as a proper stance and address of the ball by the golfer, a proper grip of the golf club, proper body position during the golf swing, and the proper swing motion. Of the aforementioned factors affecting the golfer's shot it is the proper swing motion which the is most difficult to achieve. It is also the swing motion which may very well be the most important single factor in achieving an optimum golf shot. If the golfer does not swing the golf club properly, the golfer's head may move, his body may be forced into an incorrect position, the golfer may loose the correct weight transfer or the club may be brought out of correct alignment with the ball.

A proper swing motion has two principal elements. These elements include, firstly, the physical swing plane, namely the path which the properly swung golf club must follow, and secondly, the tempo of the swing, also known as swing timing or rhythm. The tempo of the golf club swing refers to the velocity with which the golf club head is travelling through a particular phase of the swing. The tempo can, therefore, be defined as the relationship of the club speed at the various points of the swing and the timing of these points to one another, taken from the beginning of the backswing to the end of the follow-through.

For a successful golf swing, the club must not only move through a consistent and well defined physical path, but it must also follow this path with a consistent, smooth tempo or rhythm. These crucial factors can be the most elusive to refine, as it is difficult to sense exactly where or when within the swing the problem lies or its extent, since the human eye cannot easily gauge the club head speed at every instant. With the proper tempo, a golf swing becomes one fluid motion rather than a series of disjointed events. In order to achieve this fluid motion, the golfer is forced to master all elements of the swing. With proper swing tempo achieved, each part of the swing places the club and the body in the correct position and relative motion for the next portion of the swing, and so on. This is really the essential, underlying principle when people speak of having perfected or "grooved" their swing.

A factor which contributes to the difficulty in developing the proper swing motion is that it varies somewhat with the age, sex, strength, build, temperament and stature of the golfer. In spite of this difficulty, it is widely recognized that once a golfer has mastered all of the basics of the golf swing, including the proper swing plane, the remaining essential element which separates an average or even good golfer from a great golfer is the swing tempo.

Previous efforts to perfect a means of teaching the proper swing tempo include the use of slow-motion video replays of the golfer's swing, and the use of remote motion-sensing technology. With the former, the problem is in obtaining precise, useful analysis without delay as by the time the stroke has been analyzed, the golfer has forgotten how it felt.

Video replays also make a comparison between separate golf swings difficult. Proper analysis of the video requires the expertise of a professional, raising costs and decreasing availability and usability. With motion-sensing technology, the desired results can be obtained, but there are serious limitations in the application of the technology. To make the system truly reliable and usable requires extremely sophisticated technology which is not only very expensive, but which also requires carefully controlled operating conditions, as well as the installation upon the golf club and in some cases the golfer of a series of infrared light emitting diodes which must be hardwire to the system. This technology is far better suited to a laboratory or clinic than to the golf course or for home practice.

In an effort to assist golfers in learning the correct swing motion, training systems have been developed to teach golfers to swing the club in the correct physical swing plane. Known training systems act to guide the end of a golfer's club as it travels in movement. Typically, these training devices provide a means to compel the individual to swing the club along a predetermined arc or plane by using a geometric swing path for the golfer's backswing and follow-through.

Prior patents which are pertinent, include Canadian laid open patent application S.N. 2,031,458 to Bellagamba, filed Dec. 9, 1990, and U.S. Pat. No. 4,852,881 to Bellagamba et al, both of which teach a golf swing training apparatus having a PVC arcuate pipe which acts to guide the shaft of the golf club during the user's swing. U.S. Pat. No. 2,520,287, to Plunkett shows a golf club guiding device which captures a golf club and holds it in position for a spiral like swing. Zega U.S. Pat. No. 2,653,025 teaches a mechanical golf instruction aid which captures the golf club and holds it for a predetermined swing. U.S. Pat. No. 2,713,491, to Plunkett et al, teaches a golf club guiding device for guiding the club in a predetermined manner. The MacStocker U.S. Pat. No. 1,960,787 is for a golf club guiding system directing the club around a predetermined swing. U.S. Pat. No. 4,040,633 to Sciarrillo teaches a golf swing training machine supported by a base sitting on an angled surface and guides the golf club on a spiraled pipe guide. The U.S. patent to Wilson U.S. Pat. No. 3,794,329 is for a golf teaching apparatus in which the shaft of a golf club is attached to a sleeve which slides on a track to control the swing of a person practicing on the device. In U.S. Pat. No. 3,744,799 to Hightower a golf practice device has a guiding track for teaching the proper technique for swinging a golf club.

A difficulty with these known golf swing training apparatus, is that while they assist in improving the golfers accuracy in swinging the club through the correct physical swing plane, they do not assist in teaching the user the proper club swing tempo.

Additionally, known golf swing training apparatus only provide the user with a "fixed" plane of club movement. There is no means of comparing a person's club swing with a preferred club golf swing which has been executed by a professional or expert golfer.

On occasion, even an accomplished golfer may experience an "off" swing, in which something has gone wrong with his club swing motion. If the golfer's swing tempo has altered, recovery to the proper swing motion may take an extended period if the golfer has adapted to the new incorrect swing tempo. Known golf training apparatus are disadvantageous as they do not permit a progressive comparison of the swing movement with the golfer's previous golf swings, his average club swing or his best golf club swing.

While prior art patents disclose an adjustable swing training apparatus, the individual settings used for each individual golfer require precise, time consuming calibration of the swing training apparatus. This results in inefficient use of the training apparatus and increased cost in man-hours required for set-up.

Known golf training apparatus are also more suitable for teaching the proper "full" swing, as one would use with various woods and low angled irons. These known devices are of little use in teaching the proper swing motion for a sand wedge, pitching wedge or other high angle iron shots.

SUMMARY OF THE INVENTION

It is an object of this invention to overcome the disadvantages of prior art golf swing training devices by providing an inexpensive golf swing training apparatus which guides a person's golf club in the correct physical swing plane during a golf swing, and which further provides the golfer with an analysis of additional golf swing characteristics.

In another one of its objects, the present invention provides a golf swing training device which permits substantially, instantaneous comparison of a characteristic of the user's golf club swing to that of a previous or preferred golf club swing.

Another object is to provide a golf swing training apparatus which permits rapid, precise calibration of the golf club swing guide for each individual user.

Another object is to provide a golf swing training apparatus which assists the user in developing the proper swing motion for use with a number of different golf clubs.

Accordingly, the present invention provides a golf swing training apparatus having a frame with a base for sitting on the ground. An arcuate, or other known golf club swing guide is attached to the frame for guiding a person's swing by physically limiting movement of the club such that the golf club contacts the golf swing guide as it travels therealong. A device which senses a particular characteristic of the golf club swing is incorporated within the golf club training apparatus. The sensing device is connected to a microprocessor, or the like, to provide the user with an output of the sensed characteristic.

The various characteristics of the golf swing which may be analyzed, include the tempo of the swing, the distance the club traveled on the golfer's backswing or follow-through, angular distance the golf club travels away from the plane of the club swing guide, or other similar features of the club movement.

In one preferred embodiment, the sensor device is used to produce a data signal representative of the golfer's swing tempo. The sensor device comprising a number of individual induction type sensors, which are located at spaced locations within the golf club swing guide. Each sensor sequentially provides the processor with sensor readings as the club or club shaft passes thereby. The processor converts the sensor readings into an output representative of the golf swing tempo or club speed as it moves through individual parts of the swing path. The number and configuration of the sensors within the golf swing guide varies depending on the degree of accuracy which is to be achieved, and the overall cost of the golf swing training apparatus.

To analyze a particular golfer's swing, the golfer stands in the training apparatus and swings his golf club in a known manner. On each of the swing backstroke, downstroke and follow-through the club slides along the swing guide sequentially activating each of the sensors. Preferably, the microprocessor instantaneously converts the timing between sequential sensor readings which are received from the induction sensors, into a graphically displayed output. Output displayed in this manner provides the golfer with substantially immediate feedback of the tempo of his golf swing. As such, the golfer may immediately repeat his swing correcting any deficiencies in swing motion.

If desired, the tempo of the user's swing may also be compared with the tempo of a prerecorded swing stored in the memory of the microprocessor. The prerecorded swing may be the user's previous or best swing, a computer generated average of the user's previous swings, a preferred golf club swing executed by a professional golfer, or any other desired swing. The training apparatus is not restricted to teaching the proper swing motion for woods, and may also be used to establish correct swing motion for all golf clubs including pitching wedges, sand wedges and putters.

In a more preferred embodiment, the golf swing training apparatus is adjustable in height and angular position to accommodate a number of individual users. Frame members which are movable by means of an electric motor may be used in the adjustment of the golf swing guide. The electric motor is controlled by the microprocessor so as to move the golf swing training apparatus quickly and precisely to a pre-set position selected for each individual user.

In a first aspect, this invention resides in a golf swing training apparatus comprising: a frame, a golf club swing guide attached to said frame, said golf club swing guide for guiding a person's swing, the improvement wherein, said golf club swing guide including sensing means, said sensing means for generating a first set of data signals upon sensing movement of a golf club thereby during said person's swing, said first set of data signals representative of a characteristic of said person's golf club swing, and computing means, said computing means having processing means for processing said first set of data signals for generating an output signal.

In another aspect, the invention resides in a method of analyzing a golf swing using a golf swing training apparatus comprising a frame, a golf club swing guide for guiding a person's golf swing, attached to said frame; said golf club swing guide including a plurality of sensors for generating a first set of data signals upon sensing movement of a golf club thereby during said person's swing, said first set of data signals representative of the tempo of said person's swing, and a microprocessor including storage for storing a second set of data signals, said second set of data signals being representative of the tempo of a prerecorded golf club swing, said microprocessor having processing means for processing said sets of data signals for generating output signals, said method comprising the steps of swinging said golf club along said golf club swing guide to generate said first set of data signals, and comparing an output signal generated from said first set of data signals with an output signal generated from said second set of data signals.

BRIEF DESCRIPTION OF THE DRAWINGS

Other objects, features and advantages of the present invention will become apparent from the following detailed description and drawings in which.

DETAILED DESCRIPTION OF THE PREFERRED EMBODIMENT

Figure 2:
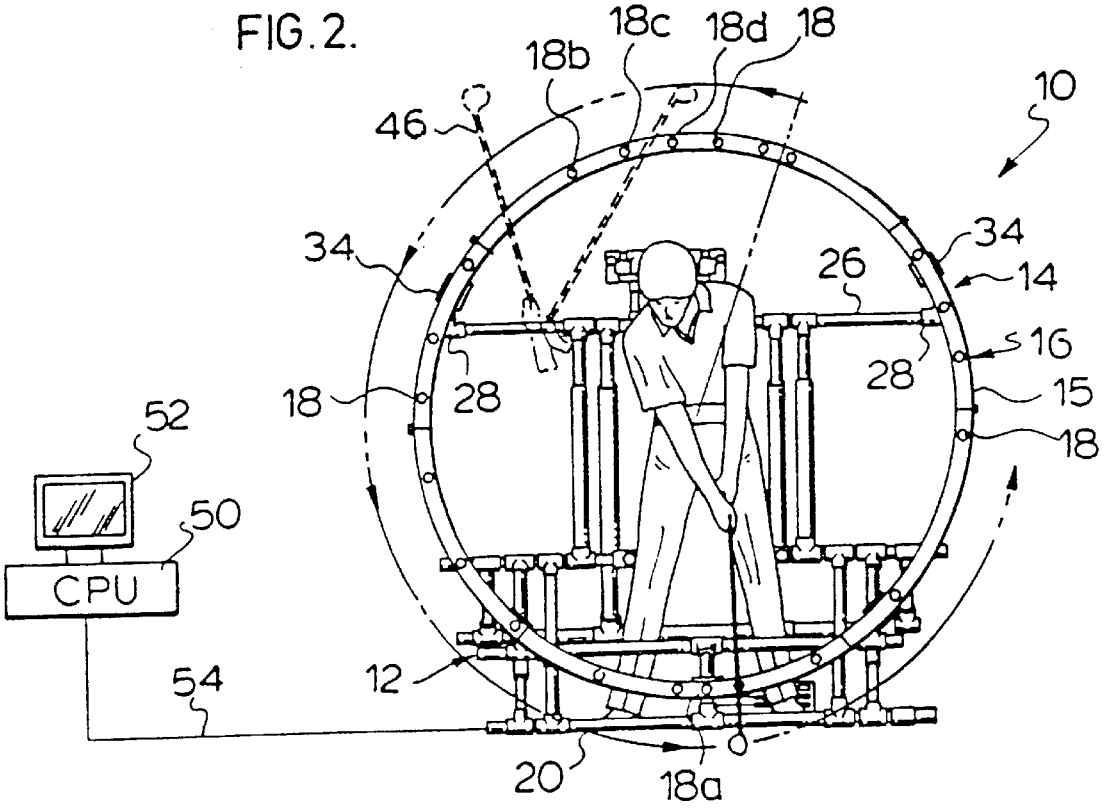
FIG. 2 is a perspective view of a golf training apparatus in accordance with a first embodiment of the invention and having a golfer positioned therein.

Reference is made first to FIG. 2, which shows a golf swing training apparatus generally indicated 10. The swing training apparatus 10 is best shown in FIG. 2 as comprising three principle elements, a frame 12, a golf club swing guide 14, and a sensor device 16 which comprises a number of individual sensors 18.

Figure 1:
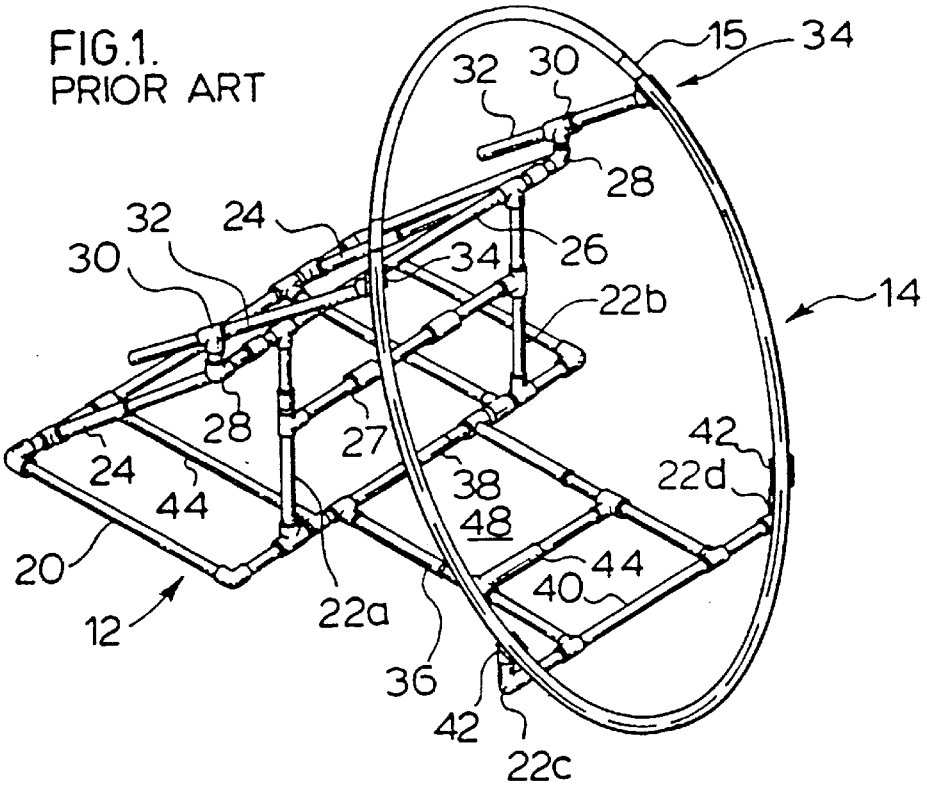
FIG.1. PRIOR ART
FIG. 1 is a perspective view of a known golf training apparatus.

In a first embodiment, the frame 12 and golf swing guide 14 are of a known construction as shown in FIG. 1. The frame 12 includes a base portion 20 for sitting on the ground. Frame 12, in addition to base 20, includes vertically extendable telescoping members 22*a*, 22*b*, 22*c* and 22*d* extending from the base 20, a pair of telescoping angled frame members 24 and horizontal frame members 26 and 27 connected between the vertical members 22*a* and 22*b*. As seen best in FIG. 1, telescoping angled frame members 24 brace vertically extending telescoping members 22*a* and 22*b* in a generally upright position. Each end of the upper horizontal member 26 is coupled to an elbow 28 having a T-joint 30 attached thereto. Each T-joint 30 has an angled support member 32 slidingly received therethrough. The forward most end of each angled support member 32 has attached clasping members 34, for supporting the upper portion of the swing guide 14. The clasping members 34 resemble a T-joint having a portion removed so as to receive in a snap fit manner a portion of the swing guide 14 which is formed as an arcuate pipe 15. The configuration of the clasping members 34 is such that in attachment clasping members 34 are spaced from the forward most surface of the guide 14 to enable the smooth slide of a golf club therealong. Independent sliding of members 32 through an associated T-joint 30 permits adjustment of the tilt of the upper portion of the swing guide 14 relative to its lower portion to adjust the angular orientation of the swing guide 14.

A pair of forwardly extending telescoping base frame members 36 are held by T-joints between a bracing member 38 and horizontal frame member 40. Each end of the horizontal frame member 40 rotatably supports telescoping vertical members 22*c* and 22*d*, which in turn support clasping members 42 similar in configuration to the clasping members 34. Additional bracing members 44 are provided in the frame 12 to provide the training apparatus 10 with added stability.

The golf club swing guide 14 comprises a circular pipe 15 which is preferably made from light weight plastics such as polyvinylchloride (PVC) which is formed into an arcuate shape approximately 6 feet in diameter. As seen best in FIG. 2, a number of individual normally-open induction type sensors 18 are located at spaced locations within the pipe 15. Each induction sensor 18 is configured to emit a sensor reading upon sensing the golf club 46 as it passes immediately adjacent thereto. The spacing of the sensors 18 along the swing guide 14 is selected to provide an accurate indication of the location of the golf club 46 during a particular phase of the golfer's swing. The sensors 18 are spaced closer together near the apex and nadir of the swing guide 14 to permit more accurate detection of swing tempo during the golfer's address of the ball and backswing where the club speed typically slows. The sensors 18 are embedded within the pipe 15 so as not to interfere with the movement of the golf club 46 as it slides along the swing guide 14 during the golfer's swing.

The swing guide 14 is designed in such a way that the swing guide 14 may be removed and a similar but smaller diameter swing guide (not shown) may be optionally substituted or added to accommodate smaller golfers, with its sensors taking the place of the sensors 18 in the standard sized swing guide 14. This changeover would be facilitated by the use of a single multiple pin wiring connector that would permit the entire set of sensors to be disconnected and re-connected in one step.

A central processing unit (CPU) 50, which includes memory and video display terminal 52, is provided in electrical connection with each of the sensors 18, by means of wiring 54. Where possible, wiring 54 is housed within the tube 15 and frame 12 so not to interfere with the golfer's swing. The CPU 50 contains the electronic circuitry which collects and processes the sensor readings to produce a graphic display on the monitor 52, representing the speed of the club 46 over each position of the swing. The CPU 50 further includes memory to store data such as the physical spacing of the individual sensors 18 relative to each other and the sensor readings produced by the user's golf swing, and/or the golf swing of others. The circuitry of the CPU 50 preferably permits the manipulation of the sensor readings, permitting an averaging of a number of the user's golf swings, or the simultaneous graphic output representing sensor readings from two or more different golf swings.

The frame 12 is designed to support the swing guide 14 in such a way that the swing guide 14 can be adjusted through a range of height and angle positions to fit the requirements of substantially all golfers of various height and stature.

As is to be appreciated, when the telescoping slide members 32 are pulled rearwards through the T-joints 30, the upper portion of the swing guide 14 can be tilted backward. Similarly, the entire swing guide 14 can be shifted forward or backwards by telescoping base frame member 36 while moving slide members 32. The guide tube 15 is assisted in its tilt by the partial rotation of telescoping members 22*c* and 22*d*. Adjustment of the height and the swing guide 14 may additionally be achieved by selectively extending or shortening the length of each vertical member 28*a*, 22*b*, 22*c* and 22*d*.

The golf swing training apparatus 10 is configured to permit a golfer free access to stand in area 48 within the frame 12. So positioned, the user may swing the golf club 46 so that the shaft of the club 46 substantially remains in sliding contact with the tube 15 throughout the entire swing, to ensure the correct physical swing plane.

In operation, the golfer stands in the correct golf position in area 48. The swing training apparatus 10 is then positioned at the appropriate height and angular position having regard to the golfer's size and stature, so that when the club 46 moves along the swing guide 14 it travels in the optimum physical swing plane.

Figure 3:
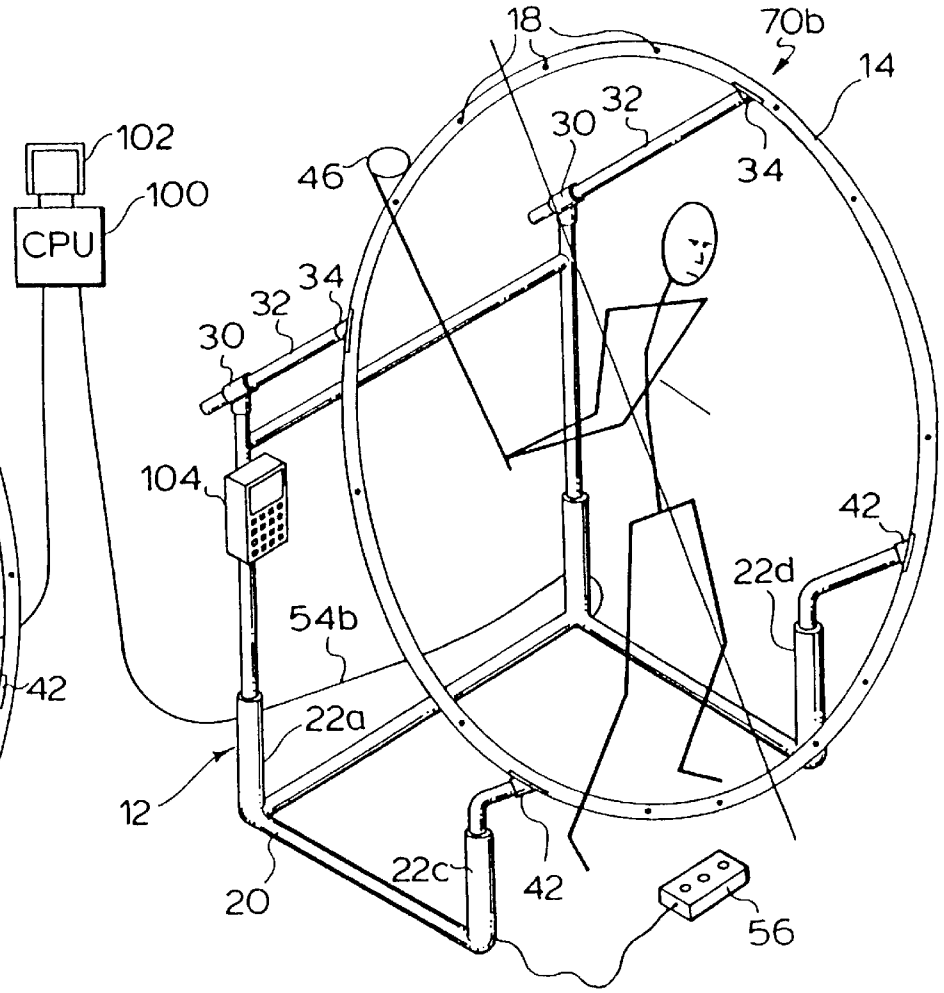
FIG. 3 is a perspective view of golf training apparatus in accordance with a second embodiment of the present invention having a golfer positioned therein.
Figure 3:
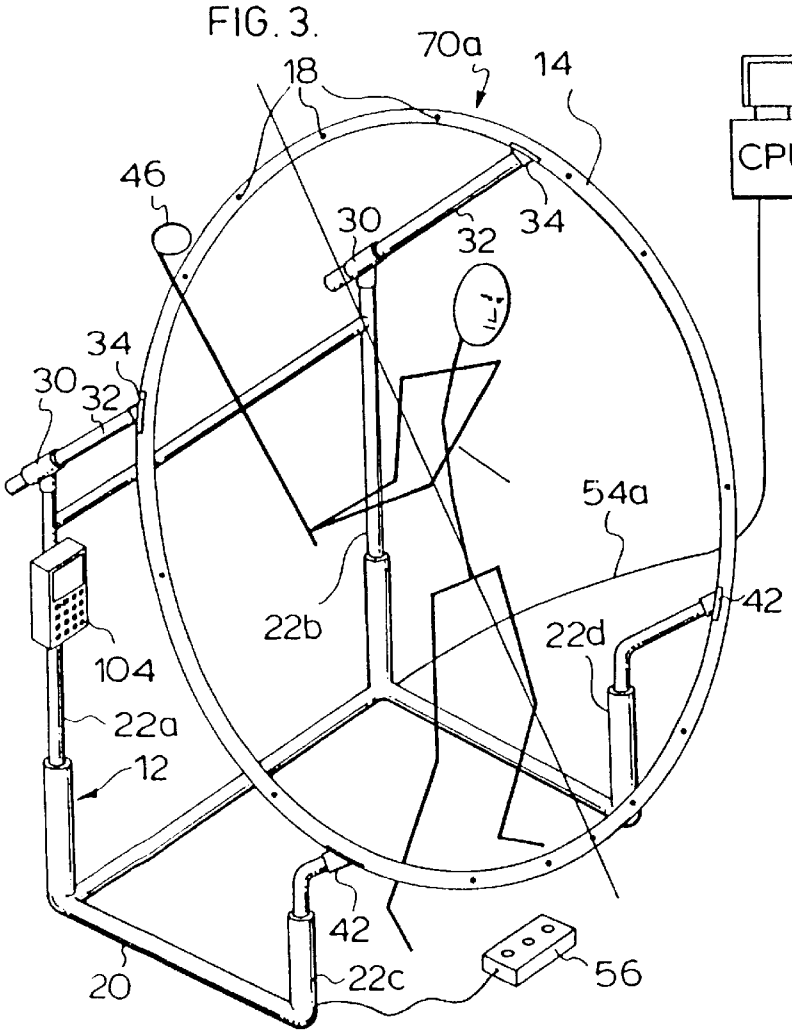
Figure 4:
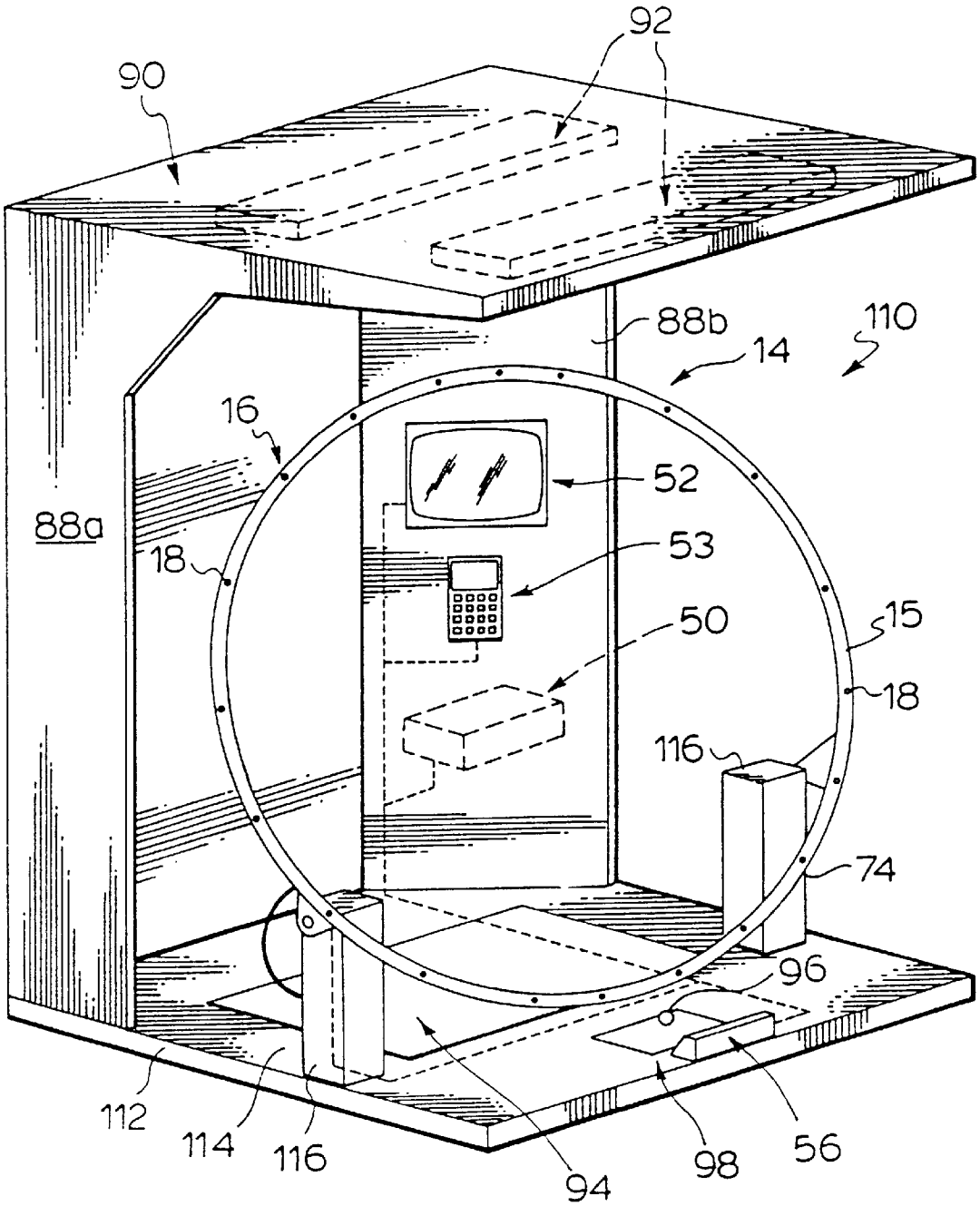
FIG. 4 is a perspective view of a golf training apparatus in accordance with a third embodiment of the invention.

With the training apparatus 10 in the correct position, the golfer next addresses the ball (shown in FIG. 4 as 96). A lower most sensor 18*a* is used to detect the presence of the golf club 46 as the golfer prepares to commence the golf swing. Once the sensor 18 detects the continual presence of the club 46 for an extended period of time, as contrasted with the period of detection during a golf swing, the CPU 50 sets the training apparatus 10 to a START mode. Preferably, the training apparatus 10 is set to a start mode on sensor 18*a*, detecting the presence of club 46 for a period of three seconds. As seen best in FIG. 3, a visual indicator panel 56 is optimally used to provide an indicator signal to the golfer that recordal of the golf swing tempo will commence once the golfer begins his swing.

Alternatively, it is also possible to provide a manual start to the recordal of the swing by means of a foot pedal microswitch or the like (not shown), however, the use of a visual indicator 56 and CPU control is advantageous as it enables the golfer to control the operation of the training apparatus 10 by the movement of the club 46, allowing repeated golf swings without breaking the user's concentration.

If the golfer shifts position before taking his swing and in the process moves the club 46 away from the sensor 18*a*, the CPU 50 will recognize this as a false start, because the loss-of-signal from sensor 18*a* was not immediately followed by a sensor reading from an adjacent sensor 18. The indicator panel 56 will provide a FALSE START signal and the CPU 50 will re-set the training apparatus 10 once the club 46 has been repositioned at sensor 18*a*. Upon the start of a swing, the loss-of-signal at sensor 18*a* is immediately followed by a brief sensor reading from an adjacent sensor 18. The CPU 50 processes the sensor reading sequence and automatically determines whether the swing is right or left-handed.

As the golfer swings club 46, beginning with the backswing and followed by the downswing and follow-through, the club 46 is detected by each sensor 18 it passes. As each sensor 18 is triggered "on" by the passing club 46, the individual sensor 18 transmits to the CPU 50 a sensor reading. The precise time interval between sensor readings from adjacent sensors 18 may be computed together with the spacing distances between the sensors 18 which are stored in the CPU 50 memory. Central Processing Unit 50 software analyzes the time for the club 46 to travel the distance between adjacent sensors to determine the tempo of the golf swing.

Two additional data manipulations are made by the Central Processing Unit 50. First, the exact transition point at which the backswing ends and the downswing begins is determined. In terms of sensor readings, there are only two sequences of readings possible. In one case, the club rises in the backswing just high enough to activate a sensor 18, but no further before the downswing. For example if sensor 18*c* is activated by a full swing, the sequence "18*b*, 18*c* and 18*b*" is produced. In the second case, the club 46 rises just beyond sensor 18*c* before reversing direction, triggering sensor 18*c* twice in a row producing the sequence "18*b*, 18*c*, 18*c* and 18*b*". In the former, the Central Processing Unit 50 would take the precise time reading for sensor 18*c* as the time of the transition from backswing to downswing. In the latter case, the Central Processing Unit 50 will take a time half-way between the two successive sensor 18*c* readings (the segment time) to be the point of transition. For graphing purposes, as in reality, the Central Processing Unit 50 assumes that the instantaneous speed at the point of transition must be "zero". Of course, in the case of a left-handed swing, or a shorter swing used with a different club, the specific sensors activated would be appropriately altered, but the same principles apply.

The CPU 50 is also used to determine the end point of the swing follow-through. As the club 46 slows to a stop, it triggers a sensor 18 for an extended period. The Central Processing Unit 50 will assume that the swing has ended when the elapsed time after the latest sensor reading is greater than double the time interval between the last two sensor readings. At this point, the swing will be assumed to have ended at the last usable sensor reading. As the club 46 was still in motion during this last time interval, the ending average speed will not be set to "zero" on the graph, however, this does not cause any difficulty in use.

Since each sensor 18 can only yield an on/off reading and not speed or direction, the pattern of readings must be analyzed in order to calculate speed and direction. Direction is, of course, fairly simple, since it is obviously the order in which the sensor readings were collected. As indicated by calculating the time interval between adjacent sensor readings and dividing this figure into the known distance between sensors 18 and adjusting for club 46 to tube 15 displacement, the speed for each segment can be calculated. However, this speed is the average speed for the segment, and to graph this, the most accurate assumption is that the average speed was achieved at the middle or centre of the segment or the corresponding time interval.

Once the golf swing is completed, the sensor readings are stored in the memory of the CPU 50 for future reference, permitting the golfer to chart the change or improvement in his swing tempo. Some, or all, of these sensor readings may also be averaged by the CPU 50 to produce a "typical" golf swing for a given golfer.

By programming the memory of the Central Processing Unit 50 with the tempo of a prerecorded golf club swing, the CPU 50 may be used to generate a comparison between the tempo of the user's swing and the tempo of the prerecorded swing almost instantly after the golfer has completed his swing. Golf swings, which are preferably prerecorded include the user's previous golf swings, or an average thereof, or a golf swing executed by a professional golfer having similar size and stature.

Figure 6:
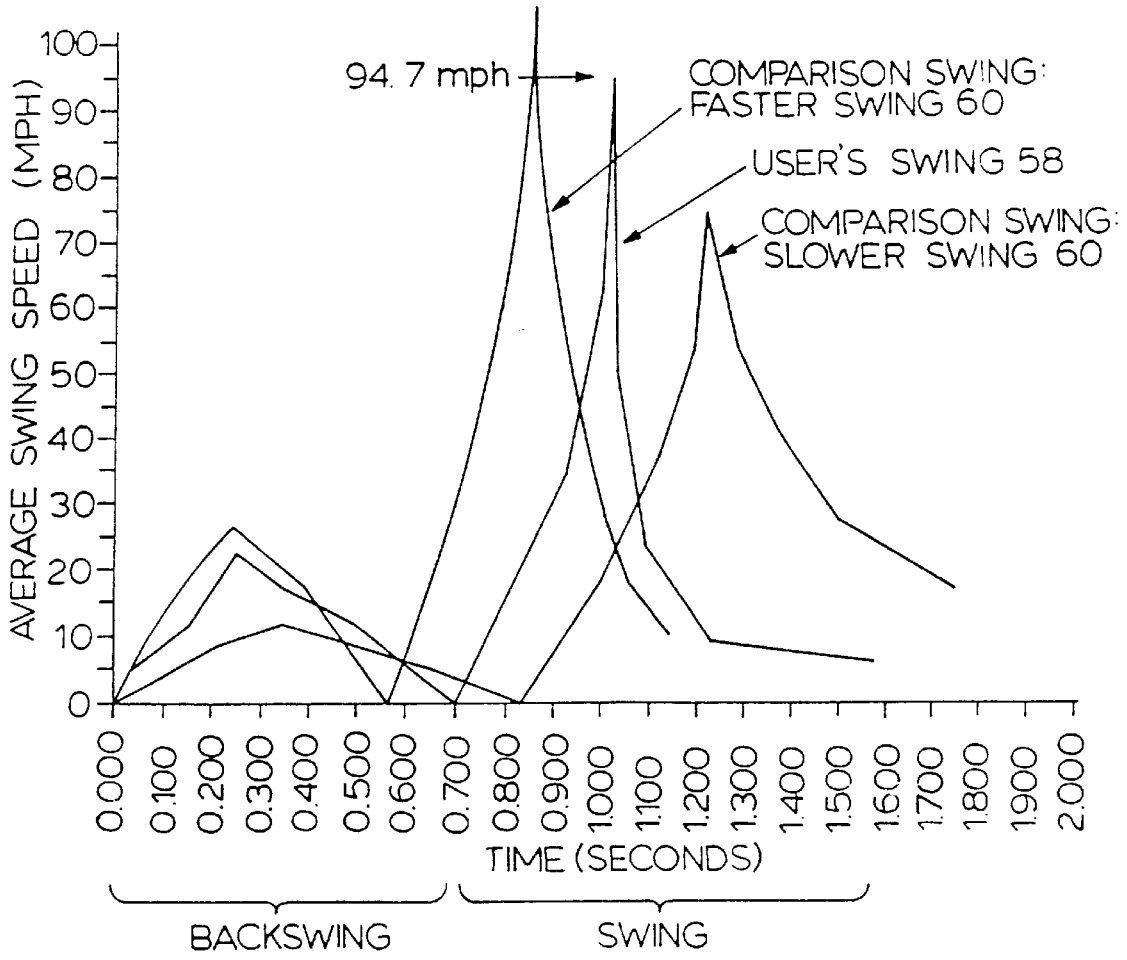
FIG. 6 is a sample output display in accordance with the present invention.

The video display terminal 52 of the Central Processing Unit 50 is used to provide a graphic output 58 of the tempo of the user's golf swing, shown best in FIG. 6. A typical output display, graphically charts the speed of the user's club 46 through the swing. If desired, multiple graphs may be simultaneously output to enable a comparison of the graphic representation of the user's swing 58 with a representation of any number of faster or slower preferred swings 60. Where a comparison between golf swings is desired, the CPU 50 may also activate a display on the indicator panel 56 to indicate the results of an overall comparison between the golfer's just-completed swing and the comparison swing, using a previously user-selected degree-of-accuracy which can be expressed as a percent (e.g. within 5%, 10%, 15%, etc.) or by the golfer's handicap. For example, if the degree-of-accuracy is set at 10%, and the golfer's overall swing stayed within +/−10% of the comparison swing, the indicator panel 56 would indicate a positive display. Alternatively, if the speed of the golfer's swing between any two sensors exceeded by 10%, or was slower than the tempo of the control swing by more than 10%, the indicator panel 56 would indicate a negative display.

FIG. 6 shows three graphs superimposed. The graph of the golfer's swing is shown as 58, while the graphs of the comparison swings are shown as 60. As is to be appreciated, the graphic display is advantageous as it instantly highlights the exact nature and extent of any error or deviation in the golfer's swing tempo. In subsequent swings, the golfer will have instant feedback on his progress in correcting his swing in a way that no human instructor can. The ability to compare a swing with a variety of other swings assists in overcoming the problem of each golfer having a slightly different personal ideal tempo. Once a golfer has perfected his swing, he can save that in the computer's memory for future comparison if his swing later changes.

FIG. 3 shows best a second embodiment of the present invention. Each of the golf swing training apparatus 70*a* and 70*b* shown have similar construction to the golf swing training apparatus 10 shown in FIG. 2 with like numerals used to designate like components.

Each golf swing training apparatus 70*a* and 70*b* comprises a frame 20 which is configured to adjustably support a swing guide 14 in various height and angular positions by the selective telescoping vertical extension of members 22*a*, 22*b*, 22*c* and 22*d*. The upper end of each vertical frame member 22*a* and 22*b* is coupled directly to a T-joint 30. Angled support members 32 slidingly received through each T-joint 30 support swing guide 14 by clasping members 34. Vertical members 22*c* and 22*d* include an angled uppermost end secured directly to clasping members 42. As is to be appreciated, the frame 12 of the training apparatus 70 may be constructed of a heavier gauge PVC pipe so as to provide a stable support for the swing guide 14, without the need for numerous bracing members.

The swing guide 14 is similar to that shown in FIG. 2. Sensors 18 are located within the swing guide for generating sensor readings as the golfer's club 46 passes thereby in the manner previously described.

In contrast to the apparatus shown in FIG. 2, sensors 18 of each of the swing training apparatus 70*a* and 70*b* are provided in electrical connection with a single Central Processing Unit 100, by means of electrical cables 54*a* and 54*b*. The Central Processing Unit 100 (CPU) includes memory and video display terminal 102. CPU 100 contains electronic circuitry which collects and processes the sensor readings produced by sensors 18 in each of training apparatus 70*a* and 70*b*.

A remote control panel 104 is provided in each of apparatus 70*a* and apparatus 70*b*. Control panel 104 allows the user to individually select the desired output configuration and parameters from within the training apparatus 70 to minimize the user's loss of concentration.

Providing a single Central Processing Unit 100 for use with multiple golf swing training apparatus 70 advantageously results in a more economical and efficient use of resources. While FIG. 3 illustrates two training apparatus 70*a* and 70*b* connected to a CPU 100, additional training apparatus may further be added.

Figure 5:
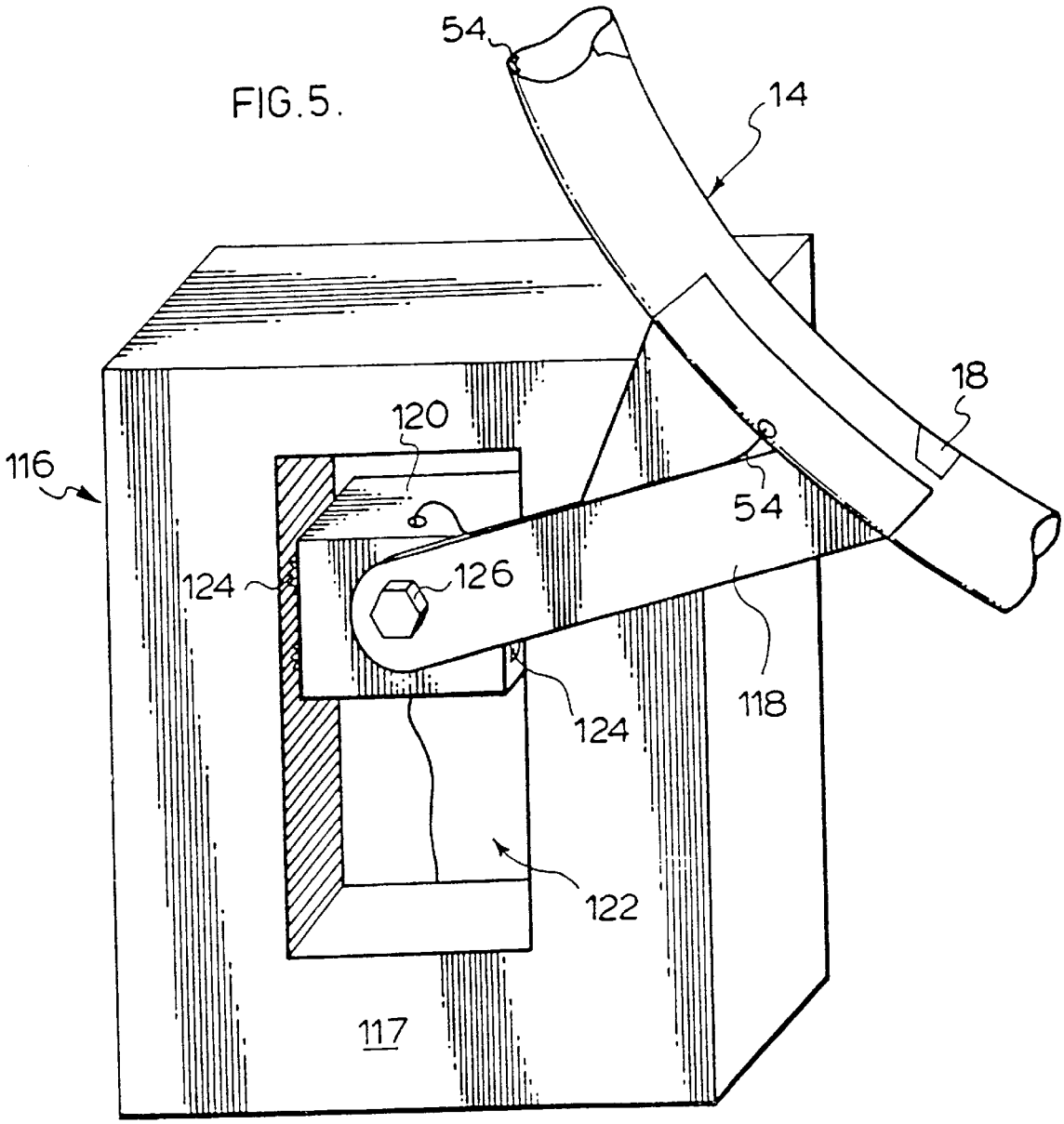
FIG. 5 is an enlarged, partial perspective view of the vertical support shown in FIG. 4.

Reference is now made to FIG. 4, which shows a golf swing training apparatus 110 in accordance with a third embodiment. The golf swing training apparatus 110 comprises a golf club swing guide 14, and sensor device 16 of a similar configuration to that shown in FIG. 2. The swing guide 14 is rigidly secured within an enclosure forming frame 112. Frame 112 includes a tabular base portion 114 for resting on the ground. In addition to the base 114, the frame 112 includes two generally vertical support members 116 projecting upwardly therefrom. As best seen in FIG. 5, each vertical support member 116 comprises a frame 117, clasping member 118 and electric motor 120. Each frame 117 includes a central, generally rectangular aperture 122. Electric motor 120 is mounted within the aperture 122 and is vertically movable therein by means of a traction drive mechanism 124. The clasping member 118 is movably secured at one end to a rotatable shaft 126 of the electric motor 120. Clasping members 118 resemble clasping members 34, shown in FIG. 1, and permit securement of the swing guide 14 to the frame 112 without interfering with the movement of golf club 46 as it travels along the swing guide 14.

As is to be appreciated, by actuating the motor 120 to move vertically within aperture 122, and/or to rotate the clasping member 118 by the rotation of shaft 126, the swing guide 14 may be moved to a number of different height and angular positions in accordance with the size and stature of the golfer using the training apparatus 110. The motor 120 may be secured in a desired position so as to secure the swing guide 14.

While shown movable by means of traction drive 124, it is to be appreciated that movement of motor 120 may be achieved by hydraulic or other drive mechanisms.

In other respects, the training apparatus 110 incorporates similar features as those disclosed in respect of the golf swing training apparatus shown in FIGS. 2 and 3, wherein similar reference numerals are used to designate similar elements. The training apparatus includes Central Processor 50, and video display terminal 52. As seen in FIG. 4, the video display terminal 52 is mounted in sidewall 88*b*, allowing substantially instantaneously viewing of the graphic output. Control panel 53 is provided within the training apparatus 110 to allow the user selection and modification of the desired output.

The Central Processing Unit 50 is programmed with desired height and angle position of the swing guide 14 of each user. The CPU 50 actuates the electric motor 120 in response to an ID code input on control panel 53, which is unique to a particular golfer. On receiving the ID code, the Central Processing Unit 50 actuates the movement of the motor 120, and thereby the swing guide 14, to the programmed height and angle position. Positioning of the guide 14 by the CPU 50 eliminates the need to take extra time to recalibrate the correct swing guide position for each new user.

In the apparatus shown in FIG. 4, the frame 112 in addition to side wall 88*b*, includes side walls 88*a* and covering panel 90, thereby permitting use of the apparatus 110 in adverse weather conditions. Lighting elements 92 may optimally be provided to permit night use of the training apparatus 110.

The use of the apparatus 110 shown in FIG. 4 is substantially the same as the use of the apparatus shown in FIG. 2. The golfer stands in the correct golf position on golf mat 94, and addresses the ball 96 located on tee 98. The visual indicator 56, located forward of the golfer and adjacent to tee 98, provides the golfer with a signal that the recordal of the golf swing tempo has commenced. Recordal and output of the golf swing tempo is achieved in substantially the same manner described with respect to the first embodiment.

While it is preferred that the output from the Central Processing Unit be in the form of a graphic representation on a video display terminal, it is appreciated that the invention is not so limited. Many other modes of and devices for output are possible.

As is to be appreciated from the drawings, and disclosure, the number and placement of individual sensors may vary. In general, the greater the number of individual sensors the greater the accuracy with which the swing tempo may be determined. While the sensors disclosed are normally open induction-type sensors, the invention is not so limited. Other suitable sensing means including, but not limited to photo and sonic operated sensors may equally be used, and will now become apparent.

While each of the three golf swing training apparatus show a particular frame structure for supporting the swing guide, it is to be appreciated that other frame structures, including single pedestal supports incorporating power adjustments for swing guide height and tilt, may be equally be substituted. Further, other swing guides which are irregularly shaped, discontinuous, or which are configured for telescoping adjustment, may equally be used with the present invention.

While the invention has been described with reference to preferred embodiments, it is not so limited. Many modifications and variations will now occur to persons skilled in the art. For a definition of the invention, reference is made to the appended claims.

We claim:

1. A golf swing training apparatus comprising a frame, a golf club swing guide for guiding a person's golf swing, attached to said frame, the improvement wherein, said golf club swing guide including sensing means, said sensing means for generating a first set of data signals upon sensing movement of a golf club thereby during said person's swing, said first set of data signals representative of a characteristic of said person's golf club swing, and computing means having processing means for processing said first set of data signals for generating an output signal representative of said characteristics of said person's swing.

2. A golf swing training apparatus as claimed in claim 1 wherein the sensor means comprises a plurality of sensors disposed at spaced locations along the swing guide for sensing the speed of the golf club along the swing guide.

3. A golf swing training apparatus as claimed in claim 2 wherein the computing means further includes memory storage means for storing a second set of data signals, said second set of data signals being representative of a characteristic of at least one first prerecorded golf club swing, the processing means for processing the second set of data signals for generating an output signal representative of said characteristic of said at least one prerecorded swing.

4. A golf swing training apparatus as claimed in claim 3 wherein, each of said first and second sets of data signals is representative of the tempo of said person's golf club swing and first prerecorded golf club swing respectively, and said first prerecorded golf club swing is selected from a preferred golf club swing and a prior one of said person's golf club swings.

5. A golf swing training apparatus as claimed in claim 4 wherein said storage means further stores a third set of data signals, said third set of data signals being representative of the tempo of a second prerecorded golf club swing selected from the other of said preferred golf club swing and said prior one of said person's golf club swings, said processing means for processing said third set of data signals for generating said output signal, said output signal representative of a comparison of said person's golf club swing and one of said first and second prerecorded golf club swings.

6. A golf swing training apparatus as claimed in claim 3 wherein said computing means includes display means for displaying said output signal.

7. A golf swing training apparatus as claimed in claim 3 wherein said processing means processes sets of data signals from a plurality of golf swing training apparatus.

8. A golf swing training apparatus as claimed in claim 1 wherein said training apparatus further comprises a guide adjustment mechanism for adjusting the height and angle of said golf club swing guide.

9. A golf swing training apparatus as claimed in claim 8 wherein said guide adjustment mechanism comprises an electric motor.

10. A golf swing training apparatus as claimed in claim 8 wherein said storage means further stores data signals representative of pre-selected height and angle positions of said golf club swing guide for a plurality of users, said computing means actuating said guide adjustment mechanism to move said golf club swing guide to a selected one of said pre-selected height and angle positions.

11. A golf swing training apparatus as claimed in claim 8 wherein said golf club swing guide forms a partial circle.

12. A golf swing training apparatus as claimed in claim 1 wherein said frame includes a base for sitting on the ground and a pair of vertical members for adjusting the height of said golf club swing guide.

13. A golf swing training apparatus as claimed in claim 1 wherein said sensing means comprises a plurality of individual spaced apart sensors.

14. A golf swing training apparatus as claimed in claim 13 wherein said golf swing guide includes an arcuate polymer pipe segment, and said sensors being located within said pipe segment.

15. A golf swing training apparatus as claimed in claim 13 wherein said sensors are induction sensors.

16. A golf swing training apparatus as claimed in claim 15 wherein said golf swing guide is an arcuate polyvinyl chloride pipe.

17. A golf swing training apparatus as claimed in claim 16 wherein said computing means comprises a personal computer.

18. A method of analyzing a golf swing using a golf swing training apparatus comprising a frame, a golf club swing guide for guiding a person's golf swing, attached to said frame; said golf club swing guide including a plurality of sensors for generating a first set of data signals upon sensing movement of a golf club thereby during said person's swing, said first set of data signals representative of the tempo of said person's swing, and a microprocessor including storage for storing a second set of data signals, said second set of data signals being representative of the tempo of a prerecorded golf club swing, said microprocessor having processing means for processing said sets of data signals for generating output signals, said method comprising the steps of swinging said golf club along said golf club swing guide to generate said first set of data signals, and comparing an output signal generated from said first set of data signals with an output signal generated from said second set of data signals.

19. A method of analyzing a golf club swing as claimed in claim 18 wherein said prerecorded golf club swing is a preferred golf club swing.

20. A method of analyzing a golf club swing as claimed in claim 18 wherein said prerecorded golf club swing is a computer generated average of a plurality of said person's previous golf club swings.

* * * * *